US009139277B2

(12) United States Patent
Kang

(10) Patent No.: US 9,139,277 B2
(45) Date of Patent: Sep. 22, 2015

(54) MULTI-STAGE WATERTIGHT CHAMBER

(71) Applicant: Chien-Chung Kang, New Taipei (TW)

(72) Inventor: Chien-Chung Kang, New Taipei (TW)

( * ) Notice: Subject to any disclaimer, the term of this patent is extended or adjusted under 35 U.S.C. 154(b) by 0 days.

(21) Appl. No.: 14/325,677

(22) Filed: Jul. 8, 2014

(65) Prior Publication Data

US 2015/0017848 A1 Jan. 15, 2015

(30) Foreign Application Priority Data

Jul. 11, 2013 (TW) ..... 102213089 U

(51) Int. Cl.

| | |
|---|---|
| ***B63H 20/32*** | (2006.01) |
| ***B63H 1/02*** | (2006.01) |
| ***B63H 23/32*** | (2006.01) |
| *B63H 23/34* | (2006.01) |
| *B63H 5/07* | (2006.01) |

(52) U.S. Cl.

CPC ..... *B63H 20/32* (2013.01); *B63H 1/02* (2013.01); *B63H 23/321* (2013.01); *B63B 2750/00* (2013.01); *B63H 5/07* (2013.01); *B63H 23/34* (2013.01)

(58) Field of Classification Search

CPC ..... B63B 20/32; B63B 23/321

USPC ..... 440/78

See application file for complete search history.

(56) References Cited

U.S. PATENT DOCUMENTS

| | | | | |
|---|---|---|---|---|
| 5,639,098 | A * | 6/1997 | MacDonald | 277/391 |
| 2004/0014380 | A1 * | 1/2004 | Varis et al. | 440/78 |
| 2015/0017848 | A1 * | 1/2015 | Kang | 440/78 |

* cited by examiner

*Primary Examiner* — Lars A Olson
*Assistant Examiner* — Jovon Hayes
(74) *Attorney, Agent, or Firm* — McClure, Qualey & Rodack, LLP

(57) ABSTRACT

A multi-stage watertight chamber is provided in this invention. The multi-stage watertight chamber comprises a first rotary seal, a second rotary seal, a first housing, a second housing, and an integrated shaft. The first and second rotary seals withstand external pressure to make sure watertight status is achieved when the integrated shaft rotates. The first housing forms a first watertight chamber. The integrated shaft protrudes through the first housing via the first rotary seal. The second housing is placed outside and adjacent to the first housing and forms a second watertight chamber. The first watertight chamber contains devices that must be isolated from liquid outside the first and second housings. The second watertight chamber is used to store water seeped through the second rotary seal and avoid causing damage directly to components and apparatus inside the first watertight chamber.

15 Claims, 9 Drawing Sheets

MULTI-STAGE WATERTIGHT CHAMBER

This application claims the benefit of priority based on Taiwan Patent Application No 102213089, filed on Jul. 11, 2013, the contents of which are incorporated herein by reference in their entirety.

CROSS-REFERENCES TO RELATED APPLICATIONS

Not applicable.

BACKGROUND OF THE INVENTION

1. Field of the Invention

The present invention relates to a multi-stage watertight chamber. More particularly, the present invention relates to a multi-stage watertight chamber that can store leaked-in water in one watertight chamber, and prevent damage to devices installed inside another watertight chamber.

2. Descriptions of the Related Art

FIG. 1 illustrates a waterproof structure 1 being applied to a shaft of motor equipment or apparatus in deep-water. The motor 10 must be protected inside the housing 11. A shaft 12 protrudes through the housing 11 to drive a load, such as a propeller 13. It is difficult to prevent the high pressure liquid outside the waterproof structure 1 from seeping in because the shaft 12 is usually rotating at high speed. Therefore, a rotary seal 14 is disposed at a position where the shaft 12 protrudes through the housing 11 to make sure waterproof status is achieved when the shaft 12 rotates. However, pressurized liquid in deep water could still leak into the housing 11 and cause damage to the equipment or apparatus installed in the housing 11 providing any flaw present with the rotary seal 14. The shaft length is long and requires the shaft 12 to be separated into a motor shaft 121 coupled to the motor 10 and a propeller shaft 122 coupled to the propeller 13. A clutch 15 is then coupled to the motor shaft 121 and the propeller shaft 122 to ensure the smooth turning of the shaft 12.

Besides, the user can only determine whether liquid is leaking into the housing 11 by disassembling the housing 11 for inspection. In addition, internal space is required inside the housing 11 to store liquid leaked into the housing 11. Said space can also be equipped with an electrical water ingress sensing means to detect early sign of water ingress in an effort to prevent damage of motor 10 or other equipment from excessive liquid accumulation. However, without a mean to visually verify the severity of the water ingress situation and a quick way to remove the accumulated liquid inside, it then requires relatively large space in the housing 11 to store water seepage until they can be removed. In this case, a risk of damage to the equipment or apparatus in the housing 11 by liquid and its vapor can not be under estimated.

SUMMARY OF THE INVENTION

An objective of the present invention is to provide a multi-stage watertight chamber 2, which comprises a first housing 20, an integrated shaft 22, a first rotary seal 202, a second housing 21, and a second rotary seal 212. The first housing 20 forms a first watertight chamber 201 to house components and equipment that needs to be isolated from fluid outside the housing. The second housing 21 forms a second watertight chamber 211 for storing water seepage from second rotary seal 212 and prevent damage to the components and equipment in the first watertight chamber 201.

The detailed technology and preferred embodiments implemented for the subject invention are described in the following paragraphs accompanying the appended drawings for people skilled in this field to well appreciate the features of the claimed invention.

DESCRIPTION OF THE PREFERRED EMBODIMENT

This invention, the multi-stage watertight chamber for an integrated shaft, provides a second watertight chamber formed adjacent to the first housings. The purpose of the second watertight chamber is to store water seepage preventing damage to devices installed in the first watertight chamber when rotary seals in either chamber starts to lose its ability to seal.

In the following description, this invention will be explained with reference to embodiments thereof. However, the description of these embodiments is only for purposes of illustration rather than limitation. It should be appreciated that in the following embodiments and attached drawings, elements unrelated to this invention are omitted from depictions; and dimensional relationships among individual elements in the attached drawings are illustrated only for ease of understanding, but not to limit the actual scale.

Figure 1:
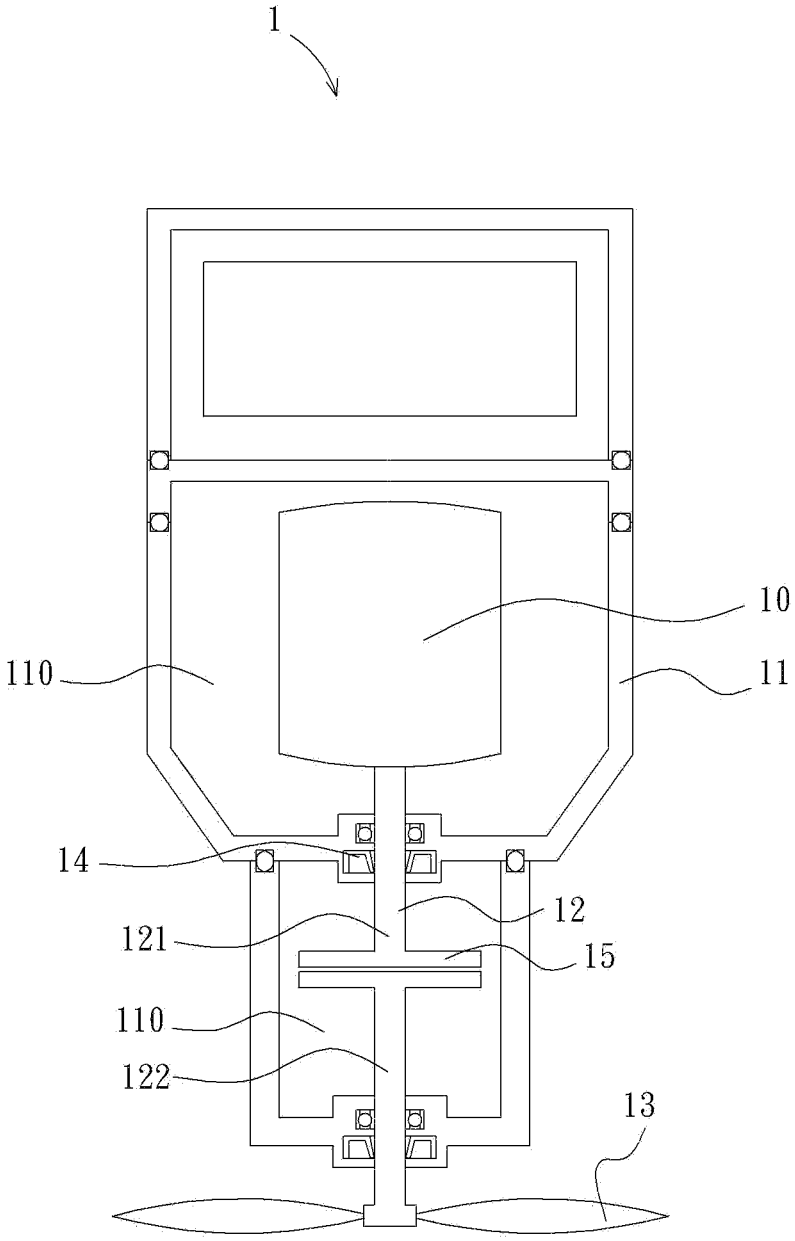
FIG. 1 (PRIOR ART)
FIG. 1 is a schematic view of a waterproof structure of the prior art.
Figure 2:
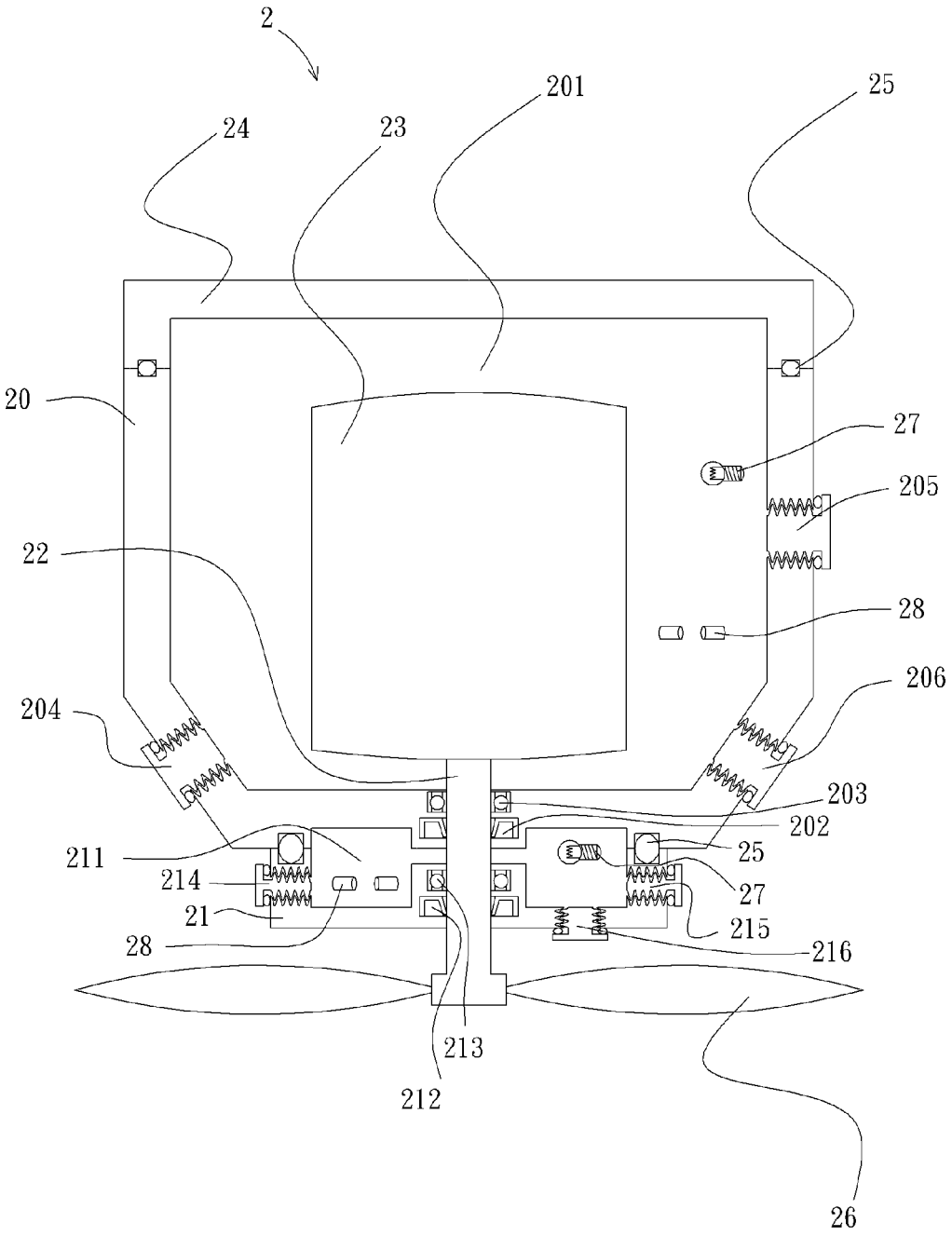
FIG. 2 is a schematic view of a first embodiment of a multi-stage watertight chamber.

Referring to FIG. 2, a multi-stage watertight chamber 2 in the first embodiment includes a first housing 20, an integrated shaft 22, a first rotary seal 202, a second housing 21, and a second rotary seal 212. The integrated shaft 22 is a one single piece integrated shaft that might rotate at a range from zero to high speed. Said integrated shaft 22 can also slide axially. The rotary seal 202 and rotary seal 212 are usually made of elastomer that can be compressed to withstand the external pressure while the integrated shaft turns or slides. Many types, shapes and sizes are commercially available for different turning or sliding speed. The first housing 20 comes with a cover 24. Said cover 24 achieves a watertight seal with the first housing 20 by compressing an elastomer 25 with mechanical means, such as screw or latch, and forms a first watertight chamber 201. Said first watertight chamber 201 is used to house component, devices, or equipment that must be isolated from liquid outside the first housing 20 and the second housing 21. The integrated shaft 22 protrudes through the first housing 20 and the second housing 21 and couples with a rotating part, such as a propeller 26. The second housing 21 is placed on the outside of the first housing 20. Said second housing 21 achieves an watertight seal with the first housing 20 also by compressing an elastomer 25 with mechanical means, such as screw or latch, and forms a second watertight chamber 211. Said second chamber 211 is used to store water seeped through the second rotary seal 212 and avoid causing damage directly to components inside the first watertight chamber 201. Such set up is to provide multi-stage watertight means for the integrated shaft 22 operating in pressurized liquid environment. Examples of waterproofing needing in pressurized liquid environment include machinery in deep sea or equipment exposed to the elements in outdoor environment. In the first embodiment, a motor 23 inside the first housing 20 drives the integrated shaft 22, which then drive a rotating part, such as the propeller 26, outside the second housing 21. For example, motorized equipment with the integrated shaft 22 operating in deep sea can utilize the second chamber 211 to store sea water seeped in and avoid causing damage to the motor 23 and other components in the first chamber 201.

Figure 3:
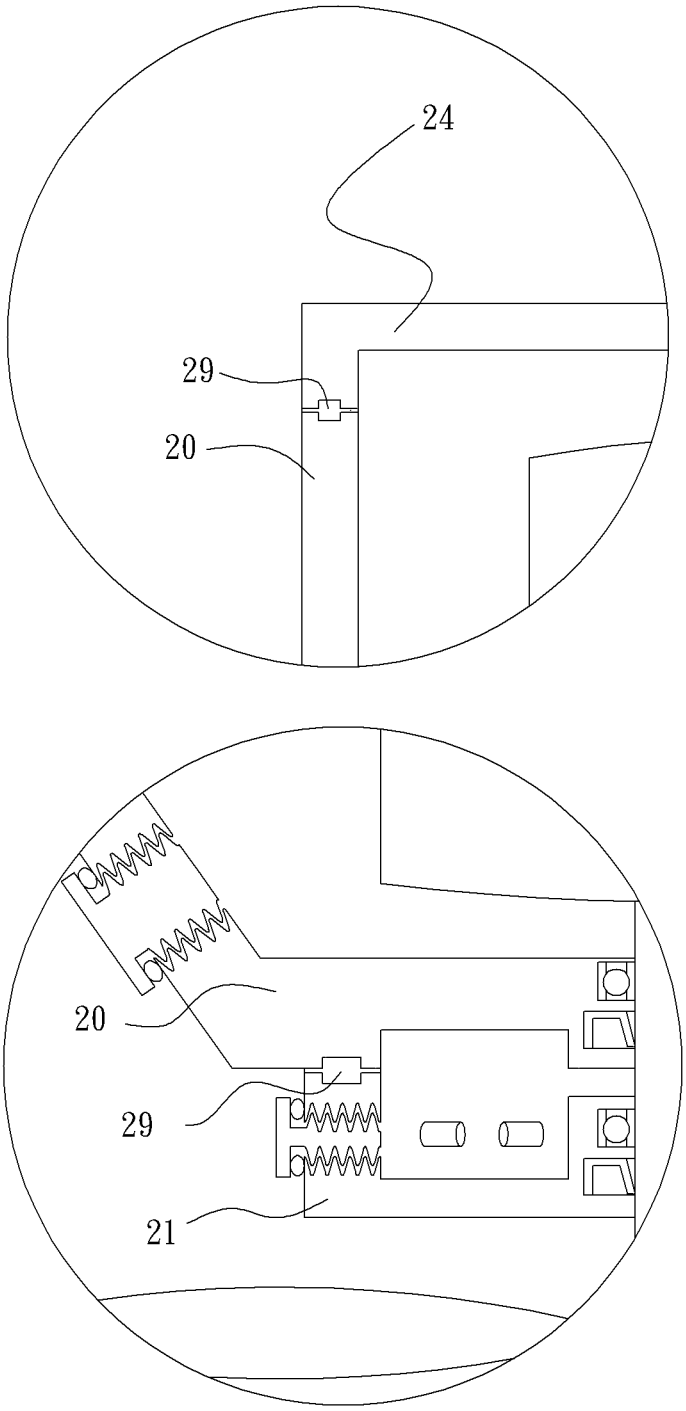
FIG. 3 is a partial enlarged view of a cover, a first housing, and a second housing of FIG. 2.

Referring to FIG. 3, the cover 24 can also be tightly sealed against the first housing 20 by directly applying elastomer gel 29 onto the contact surface and fastened by mechanical means. The watertight seal between the second housing 21 and the first housing 20 can also be done in similar fashion.

Figure 4:
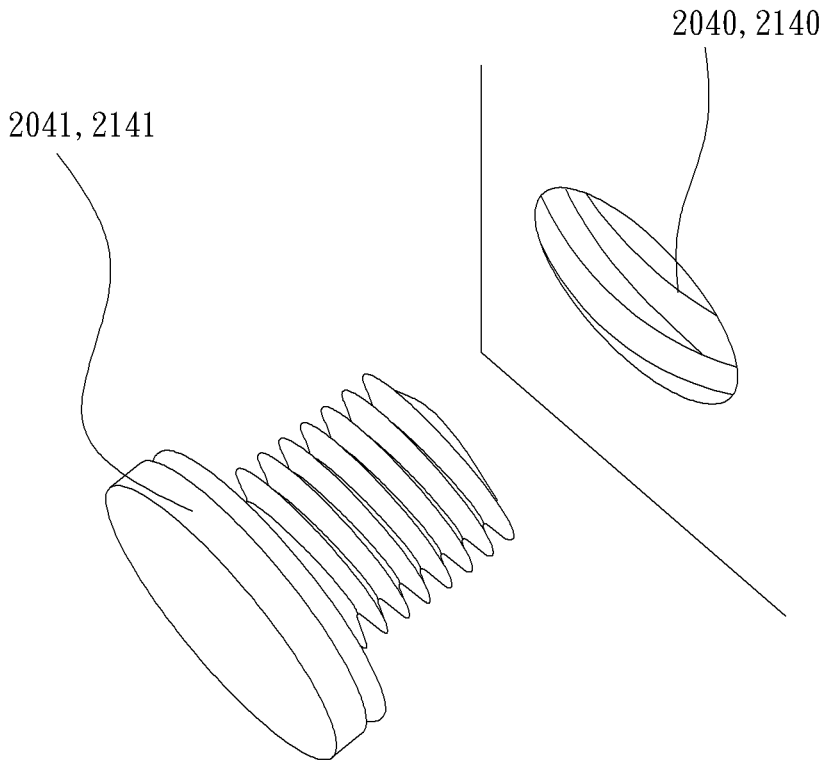
FIG. 4 is a schematic view of a drain port of a multi-stage watertight chamber.

Referring to FIG. 2 and FIG. 4, the main purpose of the first watertight chamber 201 formed inside the first housing 20 and the cover 24 is to house components, devices, or equipment that must be isolated from fluid outside. A first drain port 204 is installed on the first housing 20 to allow seeped-in fluid, such as seawater, to be drained. To drain the accumulated fluid from the first watertight chamber 201, first remove a first drain plug 2041 from a first drain hole 2040. Secondly, tilt the first watertight chamber 20 until the accumulated fluid flow toward and drain out from the first drain port 204.

The main purpose of the second watertight chamber 211 formed between the second housing 21 and the first housing 20 is to store water seeped through the second rotary seal 212. A second drain port 214 is installed on the second housing 21 to allow seeped-in fluid, such as seawater, to be drained. To drain the accumulated fluid from the second watertight chamber 211, first remove a second drain plug 2141 from a second drain hole 2140. Secondly, tilt the second watertight chamber 21 until the accumulated fluid flow toward and drain out from the second drain port 214.

Besides, a first air pumping valve 206 or a second air pumping valve 216 can be installed to help expel the seeped-in fluid out by pumping air into the first watertight chamber 201 or the second watertight chamber 211. By increasing air pressure inside the first watertight chamber 201 or the second watertight chamber 211, the pressure difference between the first watertight chamber 201 and second watertight chamber 211 and outside environment can be decreased to subsequently reduce the chance for the pressurized liquid to seep in from outside. After draining the fluid, the first drain plug 2041 or the second drain plug 2141 can be reinstalled, and the second watertight chamber 211 can then be used again to store fluid that seeped in. The second drain port 214, the second drain plug 2141, and the second drain hole 2140 are similar in design as the first drain port 204, the first drain plug 2041, and the first drain hole 2040 shown in FIG. 4.

Figure 5:
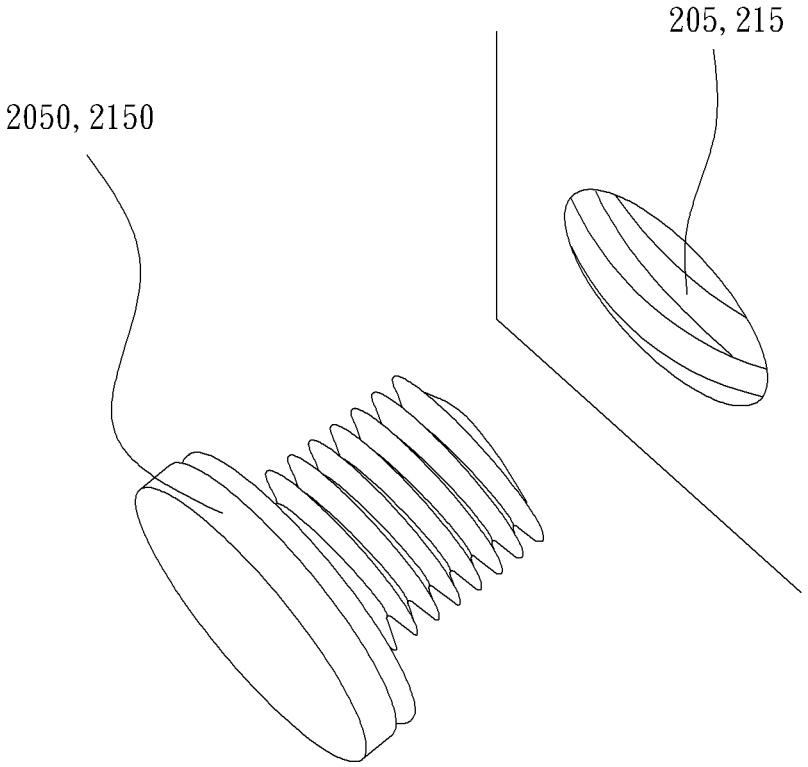
FIG. 5 is a schematic view of a vent port of a multi-stage watertight chamber.

Referring to FIG. 2 and FIG. 5, a first vent port 205 and a second vent port 215 can be respectively placed on the first housing 20 and the second housing 21 to provide passage way for air to enter allowing accumulated water to be drained with ease. A first vent plug 2050 and a second vent plug 2150 are respectively set up on the first vent port 205 and the second vent port 215 to allow air passage when opened and to maintain watertight when plugged. A one way valve can also be installed on the first vent port 205 or the second vent port 215 to avoid air from escaping from the vent port and thus reduce the water draining efficiency.

Figure 6:
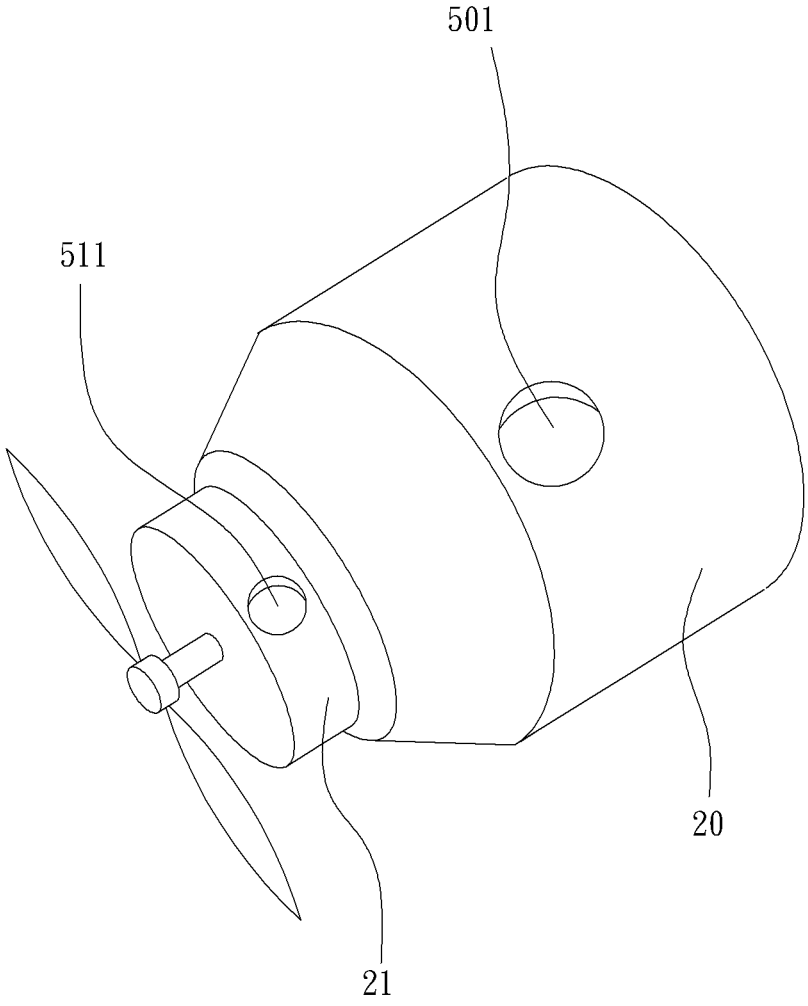
FIG. 6 is an isometric view of a multi-stage watertight chamber.

Referring to FIG. 6, at least part of the first housing 20 or the second housing 21 can be a transparent part 501, 511 that provides a view port for the user allowing visual inspection to determine whether any water accumulated inside the first housing 20 or the second housing 21. For example, a diver underwater can perform visual inspection to detect early sign of water ingress as well as to see if accumulated water volume requires removal.

Referring to FIG. 2, an illumination light 27 can be installed inside the first watertight chamber 201 or the second watertight chamber 211. This serves to light up the internal space and provide reflection glare from accumulated water. The illumination can help the user to visually identify sign of water ingress.

Figure 7:
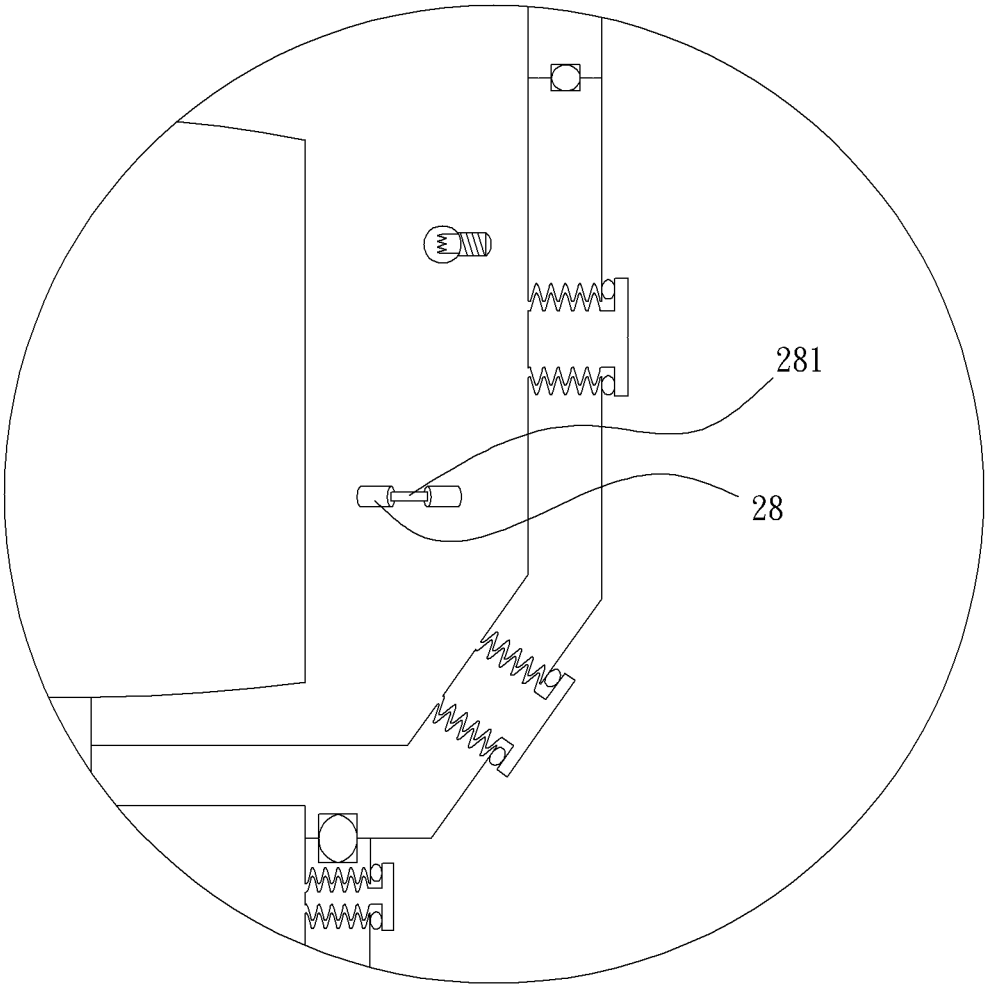
FIG. 7 is a partial enlarged view of an inflow sensing device of FIG. 2.

Referring to FIG. 2 and FIG. 7, a water ingress sensor 28 can be installed inside the first watertight chamber 201 or the second watertight chamber 211 to electronically detect water ingress. The water ingress sensor 28 consists of two conductor terminals adjacent but not contacting each other which form a closed loop when water exist between two conductor terminals. Water absorbent material 281 can be added onto two conductor terminals to absorb water and increase detection efficacy on minute amount of water.

Referring to FIG. 2, a first position restrainer 203 can be placed near the rotary seal 202 to align the integrated shaft 22 with the first rotary seal 202. A second position restrainer 213 can also be placed near the rotary seal 212 to align the integrated shaft 22 with the second rotary seal 212. The first position restrainer 203 or the second position restrainer 213 can be a bearing or a shaft sleeve.

Referring to FIG. 2, the gap between first housing 20 and the second housing 21 can be reduced to a smaller gap only wide enough to allow seeped-in water to pass through and eventually accumulate in the second watertight chamber 211. By doing so, the length of the integrated shaft 22 can be greatly reduced. The length reduction make an one single piece integrated shaft practical instead of having to use two separate shaft pieces coupled together.

Figure 8:
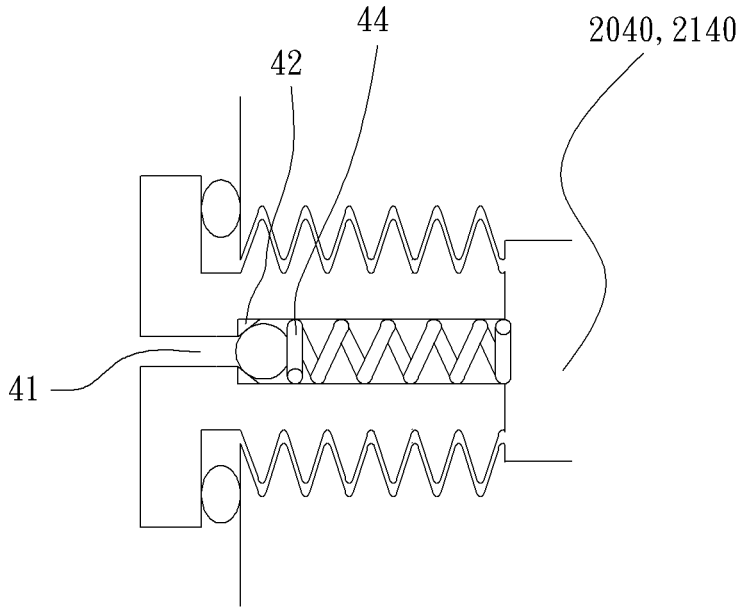
FIG. 8 is a schematic view of an one-way valve and a drain hole of the drain port of a multi-stage watertight chamber.

Referring to FIG. 2, FIG. 4, and FIG. 8, the drain hole 2040, 2140 can also be fitted with an one-way valve 41. An elastomer 42, such as an o-ring, is placed on a contact surface between the one-way valve 41 and the drain hole 2040, 2140. The elastomer 42 is then compressed by a spring 44 to form an watertight seal between the one-way valve 41 and the drain hole 2040, 2140. To drain water by forcing air in through the one-way valve 41, the one-way valve 41 can be unscrewed slightly in advance to break the seal. Tilt the first housing 20 or the second housing 21 to allow the accumulated water to flow toward the first drain port 204 or the second drain port 214. The high pressure gas influx will propel water out through the port with ease.

Figure 9:
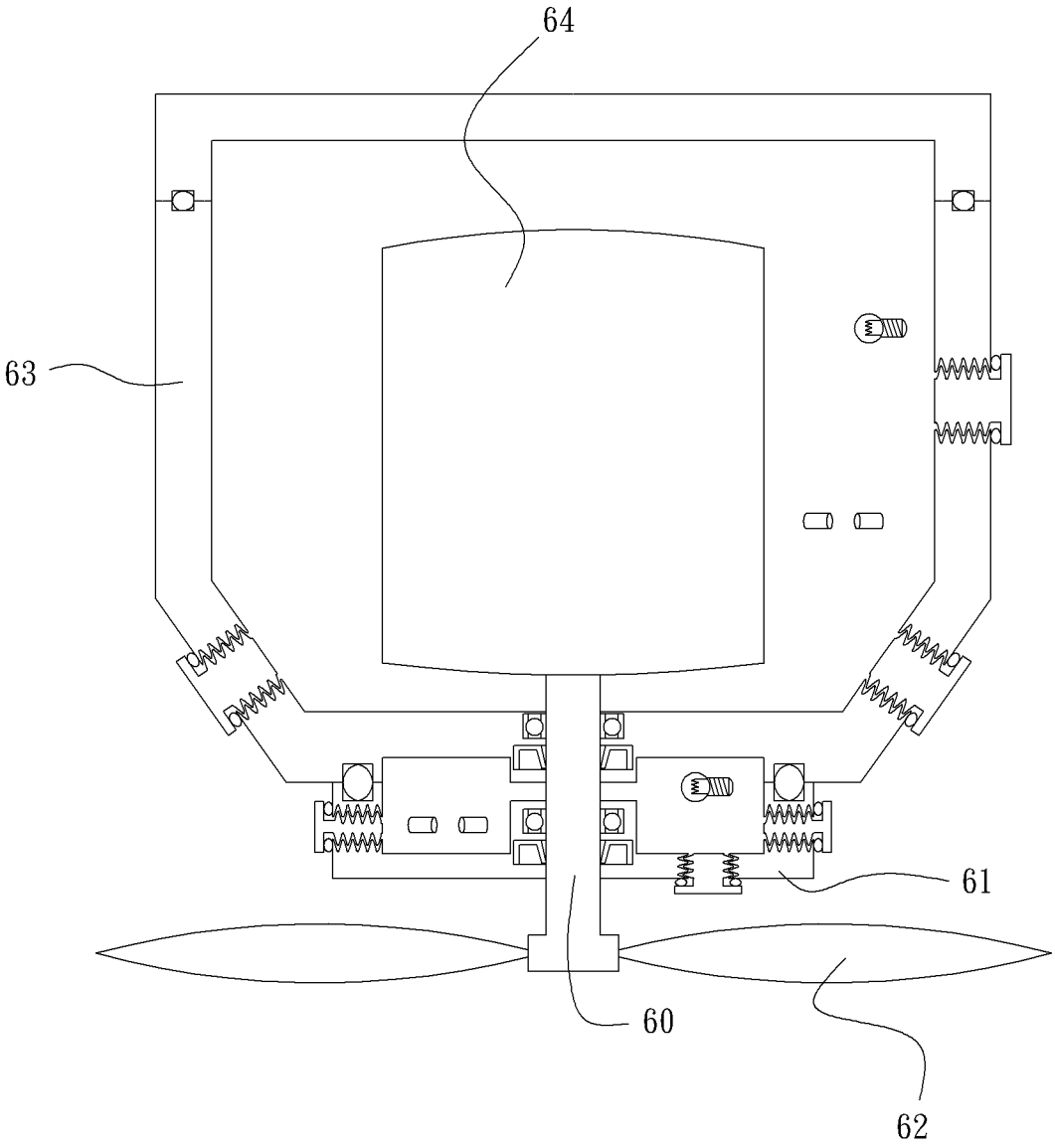
FIG. 9 is a schematic view of a second embodiment of a multi-stage watertight chamber.

Referring to FIG. 9, in the second embodiment of the invention, an integrated shaft 60 that protrudes through a first housing 63 and a second housing 61 can be driven by a rotating part, such as a propeller 62, outside the second housing 61. The integrated shaft 60 can then subsequently drive a generator 64.

The above embodiments merely give the detailed technical contents of the present invention and inventive features thereof, and are not to limit the covered range of the present invention. People skilled in this field may proceed with a variety of modifications and replacements based on the disclosures and suggestions of the invention as described without departing from the characteristics thereof. Nevertheless, although such modifications and replacements are not fully disclosed in the above descriptions, they have substantially been covered in the following claims as appended.

What is claimed is:

1. A multi-stage watertight chamber, comprising:

a first rotary seal;

a second rotary seal;

a first housing, being configured for forming a first watertight chamber, wherein the first watertight chamber is configured for installing devices isolated from liquid outside the multi-stage watertight chamber;

a second housing, placed outside of the first housing, being configured for forming a second watertight chamber with the first housing, wherein the second watertight chamber is configured for storing water seeped through the second rotary seal and avoiding causing damage directly to devices inside the first watertight chamber; and an integrated shaft protruding through the first housing via the first rotary seal, wherein the first and second rotary seals are configured to withstand liquid pressure to make sure watertight status is achieved when the integrated shaft rotates or slides axially.

2. The multi-stage watertight chamber as claimed in claim 1, wherein one of the first and second housings comprises a drain port being configured to allow seeped-in fluid inside one of the first and second watertight chambers to be drained through.

3. The multi-stage watertight chamber as claimed in claim 1, wherein one of the first and second housings comprises a drain port and an air pumping valve, and the air pumping valve is configured to increase air pressure inside one of the first and second watertight chambers to help expel seeped-in fluid inside one of the first and second watertight chambers through the drain port.

4. The multi-stage watertight chamber as claimed in claim 1, wherein at least part of one of the first and second housings is transparent, allowing visual inspection to determine whether fluid accumulated inside one of the first and second watertight chambers.

5. The multi-stage watertight chamber as claimed in claim 1, wherein one of the first and second watertight chambers comprises a water ingress sensor, consisting of two conductor terminals adjacent but not contacting each other, being configured to form a closed loop when water exists between the two conductor terminals.

6. The multi-stage watertight chamber as claimed in claim 1, wherein one of the first and second watertight chambers comprises an illumination light, and the illumination light is configured to illuminate one of the first and second watertight chambers for visual inspection of water existence.

7. The multi-stage watertight chamber as claimed in claim 1, wherein one of the first and second housings comprises a vent port, and the vent port is configured to let air in and allow accumulated water inside one of the first and second watertight chambers to be drained with ease.

8. The multi-stage watertight chamber as claimed in claim 1, wherein the integrated shaft is driven by a motor inside the first watertight chamber to drive a rotating part.

9. The multi-stage watertight chamber as claimed in claim 1, wherein the integrated shaft is driven by a rotating part outside the second housing to drive a generator inside the first watertight chamber.

10. The multi-stage watertight chamber as claimed in claim 8, wherein the rotating part is a propeller.

11. The multi-stage watertight chamber as claimed in claim 1, wherein the first housing comprises a position restrainer, installed at where the integrated shaft protrudes through the first housing, being configured to align the integrated shaft with the first rotary seal to make sure watertight status of the first rotary seal is achieved.

12. The multi-stage watertight chamber as claimed in claim 1, wherein the integrated shaft protrudes through the second housing via the second rotary seal, and the second housing comprises a position restrainer, installed where the integrated shaft protrudes through the second housing, being configured to align the integrated shaft with the second rotary seal to make sure watertight status of the second rotary seal is achieved.

13. The multi-stage watertight chamber as claimed in claim 11, wherein the position restrainer is one of a bearing and a shaft sleeve.

14. The multi-stage watertight chamber as claimed in claim 9, wherein the rotating part is a propeller.

15. The multi-stage watertight chamber as claimed in claim 12, wherein the position restrainer is one of a bearing and a shaft sleeve.

* * * * *